US008528763B2

(12) United States Patent
Svensson

(10) Patent No.: US 8,528,763 B2
(45) Date of Patent: Sep. 10, 2013

(54) PRESSURE VESSEL FOR A HIGH PRESSURE PRESS

(75) Inventor: Lennart Svensson, Västerås (SE)

(73) Assignee: Avure Technologies AB, Vasteras (SE)

( * ) Notice: Subject to any disclaimer, the term of this patent is extended or adjusted under 35 U.S.C. 154(b) by 45 days.

(21) Appl. No.: 13/138,592

(22) PCT Filed: Mar. 11, 2009

(86) PCT No.: PCT/EP2009/001744

§ 371 (c)(1),
(2), (4) Date: Nov. 21, 2011

(87) PCT Pub. No.: WO2010/102645

PCT Pub. Date: Sep. 16, 2010

(65) Prior Publication Data

US 2012/0085758 A1 Apr. 12, 2012

(51) Int. Cl.
*F17C 1/00* (2006.01)

(52) U.S. Cl.
USPC ..... 220/4.01; 220/4.24; 220/4.25; 220/4.12; 220/4.21; 220/581; 220/584; 220/592; 220/646; 220/648; 220/588; 285/15; 285/368; 285/412; 285/414; 285/93; 285/294.1; 285/370; 29/402.01; 29/402.02; 277/614; 277/613; 277/616; 277/650

(58) Field of Classification Search
CPC ..... F17C 1/06
USPC ..... 220/4.12, 4.25, 4.24, 4.21, 581, 220/584, 588, 4.06, 4.07, 589, 586, 587, 220/320, 319, 378, 4.13; 138/97, 111, 112, 138/174, 176; 156/184, 185; 376/294, 263; 51/411, 410, 104.05; 285/65, 66, 70, 76, 285/15, 61, 365, 407, 408, 411, 368, 412, 285/333, 370, 22; 277/637, 644, 650, 602, 277/647, 613, 603, 171, 905, 614, 314; 29/402.03, 402.08, 402.19, 890.06, 402.02, 29/402.038, 402.09, 402.11, 235, 282, 770
See application file for complete search history.

(56) References Cited

U.S. PATENT DOCUMENTS 2,243,240 A * 5/1941 Zerbe ..... 196/133
2,487,241 A * 11/1949 Hilton ..... 285/334.2

(Continued)

FOREIGN PATENT DOCUMENTS

BE 568071 A 6/1958
CA 2253040 A1 5/2000

(Continued)

OTHER PUBLICATIONS

International Search Report.

(Continued)

*Primary Examiner* — Mickey Yu
*Assistant Examiner* — Gideon Weinerth
(74) *Attorney, Agent, or Firm* — Harness, Dickey & Pierce P.L.C.

(57) ABSTRACT

The present invention relates to a pressure vessel (1) for a high pressure press comprising at least a first sub-cylinder (4) and a second sub-cylinder (6), which are axially connected to form a cylinder body (2) for enclosing a high pressure medium, and a sealing arrangement arranged at the inner wall of the cylinder body for sealing the joint (3) between the first and the second sub-cylinder (4, 6) against leakage of the pressure medium. The sealing arrangement is comprising a ring shaped sealing band (18), a first circumferential protruding flange (30), which is arranged on the inner wall of the first sub-cylinder and which axially extends from the joint (3) and away from the second sub-cylinder (6), and a second circumferential protruding flange (32), which is arranged on the inner wall of the second sub cylinder (6) and which axially extends from the joint (3) and away from the first sub-cylinder (4). The sealing band (18), in mounted position, is located concentrically within the first and the second protruding flanges (30, 32) such that it in a radially pre-stressed manner abuts against the first and second protruding flanges (30, 32) and sealingly overlaps the joint (3) between the first and the second sub-cylinder (4, 6). The sealing arrangement further comprises a first circumferential mounting space (51), which is arranged in the inner wall of the first sub-cylinder (4) and which axially extends from the first protruding flange (30) and away from the second sub-cylinder (6), for facilitating exchange of components of the sealing arrangement.

19 Claims, 4 Drawing Sheets

(56) References Cited

U.S. PATENT DOCUMENTS

| | | | | | |
|---|---|---|---|---|---|
| 2,629,354 | A | * | 2/1953 | Gay | 269/26 |
| 2,792,242 | A | * | 5/1957 | Hamlin | 235/117 A |
| 2,839,218 | A | * | 6/1958 | Zerbe | 220/240 |
| 2,903,279 | A | * | 9/1959 | Bergstedt et al. | 285/373 |
| 3,141,685 | A | * | 7/1964 | Watts | 285/93 |
| 3,228,550 | A | * | 1/1966 | Krenzke | 220/586 |
| 3,357,594 | A | * | 12/1967 | Grosh et al. | 220/683 |
| 3,357,721 | A | * | 12/1967 | Hollanszky et al. | 285/1 |
| 3,398,853 | A | | 8/1968 | Jorgensen | |
| 3,508,677 | A | * | 4/1970 | Laibson et al. | 220/590 |
| 3,598,275 | A | * | 8/1971 | Francois | 220/675 |
| 3,613,157 | A | * | 10/1971 | Landa | 425/77 |
| 3,655,090 | A | | 4/1972 | Rothrock et al. | |
| 3,877,730 | A | * | 4/1975 | Frantz | 285/15 |
| 3,999,825 | A | * | 12/1976 | Cannon | 439/192 |
| 4,006,838 | A | * | 2/1977 | Baumann et al. | 220/586 |
| 4,008,937 | A | * | 2/1977 | Filippi | 439/192 |
| 4,013,394 | A | * | 3/1977 | Witkin et al. | 425/78 |
| 4,040,372 | A | * | 8/1977 | Flanders | 413/9 |
| 4,109,923 | A | * | 8/1978 | Tuckmantel | 277/612 |
| 4,192,225 | A | * | 3/1980 | Moyer | 92/169.1 |
| 4,372,565 | A | * | 2/1983 | Lien | 277/614 |
| 4,537,406 | A | * | 8/1985 | Hirasuna et al. | 277/314 |
| 4,626,002 | A | | 12/1986 | Hagemeister et al. | |
| 4,732,556 | A | | 3/1988 | Chiang et al. | |
| 4,813,120 | A | * | 3/1989 | Fournier | 29/426.6 |
| 4,832,380 | A | * | 5/1989 | Oetiker | 285/328 |
| 4,913,464 | A | * | 4/1990 | Taylor et al. | 285/15 |
| 5,011,196 | A | * | 4/1991 | Sabatier et al. | 285/367 |
| 5,039,140 | A | * | 8/1991 | Szymczak | 285/334.2 |
| 5,075,945 | A | * | 12/1991 | Krzecki | 29/235 |
| 5,547,228 | A | * | 8/1996 | Abbema et al. | 285/22 |
| 5,547,533 | A | * | 8/1996 | Berglund | 156/175 |
| 5,944,319 | A | * | 8/1999 | Kohlman | 277/314 |
| 6,499,908 | B2 | * | 12/2002 | Hauptmann et al. | 403/322.2 |
| 6,561,521 | B2 | * | 5/2003 | Janoff et al. | 277/603 |
| 6,758,500 | B2 | * | 7/2004 | Lehnhardt | 285/365 |
| 6,979,025 | B2 | * | 12/2005 | Conder et al. | 285/55 |
| 7,107,662 | B1 | * | 9/2006 | Levario | 29/505 |
| 7,350,453 | B1 | * | 4/2008 | Bailey et al. | 92/128 |
| 7,931,310 | B2 | * | 4/2011 | Lake | 285/365 |
| 8,316,905 | B2 | * | 11/2012 | Sehlstedt et al. | 156/382 |
| 2004/0026431 | A1 | * | 2/2004 | Jones | 220/588 |
| 2004/0046388 | A1 | * | 3/2004 | Slack et al. | 285/333 |
| 2006/0099366 | A1 | | 5/2006 | Takemoto et al. | |
| 2006/0180036 | A1 | | 8/2006 | Lonneborg | |
| 2007/0013147 | A1 | * | 1/2007 | Granquist | 277/632 |
| 2007/0218160 | A1 | | 9/2007 | Sehlstedt | |
| 2007/0284879 | A1 | * | 12/2007 | Fusser | 285/370 |
| 2008/0053554 | A1 | * | 3/2008 | Salama | 138/172 |
| 2009/0038487 | A1 | * | 2/2009 | Svensson | 100/43 |
| 2010/0075200 | A1 | * | 3/2010 | Hatta | 429/34 |
| 2010/0219185 | A1 | * | 9/2010 | Griffin et al. | 220/4.07 |
| 2012/0205379 | A1 | * | 8/2012 | Sakairi | 220/320 |

FOREIGN PATENT DOCUMENTS

| | | | |
|---|---|---|---|
| EP | 0 310 369 | | 4/1989 |
| EP | 1 707 346 | | 10/2006 |
| FR | 2558234 | A1 | 7/1985 |
| GB | 305609 | A | 2/1929 |
| JP | 56-55154 | | 5/1981 |
| JP | 1-164805 | | 6/1989 |
| WO | WO 2004/051138 | | 6/2004 |
| WO | WO-2004/082405 | A1 | 9/2004 |
| WO | WO-2005079966 | A1 | 9/2005 |

OTHER PUBLICATIONS

European Office Action dated Jan. 16, 2013.

Translation of Japanese Office Action for corresponding Japanese application dated Jun. 4, 2013.

Chinese Office Action for corresponding Chinese application dated Apr. 27, 2013.

* cited by examiner

PRESSURE VESSEL FOR A HIGH PRESSURE PRESS

TECHNICAL FIELD OF THE INVENTION

The present invention relates to a high pressure press comprising a first sub-cylinder and a second sub cylinder which are axially connected and sealed by a sealing arrangement. The invention further relates to a method of replacing components of the sealing arrangement.

BACKGROUND ART

During a high pressure pressing operation of an high pressure press, a pressure medium is pressurized to a very high pressure. The pressure medium is a fluid. High pressure presses can be used in various applications. A high pressure press can for example be used for forming of sheet metal parts into predetermined shapes by highly pressurizing a fluid provided in a closed pressure vessel and use as an exerting force onto an intermediate diaphragm or the like. If the high pressure press exerts an equal pressure on every side of the contents in the pressure vessel, the press is called an isostatic press. Isostatic presses can be used for compaction or densification of metallic or ceramic powders, for reduction of pores or voids in castings or sintered articles, for sterilization and preservation of food stuffs, etc. Depending on the temperature of the pressure medium during an isostatic pressing process, the process can be called a hot isostatic pressing (HIP), a warm isostatic pressing or a cold isostatic pressing (CIP).

A pressure vessel of a conventional high pressure press comprises a cylinder body. The cylinder body is closed by closure lids at the cylinder ends. A framework is arranged to hold the closure lids at the ends of the cylinder body.

To increase the ability of the pressure vessel to resist crack formation and propagation, the pressure vessel is commonly prestressed. The vessel for example be prestressed by autofrettage, by shrinkage or by wire-winding.

The pressure level in the pressure vessel depends on the press type and the material to be pressed. In sheet metal forming the press is typically designed for pressures up to 140 MPa, in CIP for between 100 MPa and 600 MPa and in HIP for up to 300 MPa.

A cylinder for a high pressure press is traditionally manufactured by forging. A cylindrical body is first casted and subsequently forged to form a cylinder body. After a heat treatment the cylinder body is machined into its final shape and dimension. To manufacture very large cylinders put high demands on the equipments for the forging-, heat treatment- and machining processes.

Recently the demand for larger and larger sizes of the articles to be pressed has increased, implying a demand for larger and larger presses. One alternative way of producing larger presses is the manufacturing of pressure vessels with a cylinder body comprising connected sub-cylinders. The cylinder body can then comprise two or more individual sub-cylinders arranged in connection with each other, whereby the dimension of the cylinder body of the isostatic press is not limited by the manufacturing process of one single large cylinder.

Not only large presses would benefit from a cylinder body comprising connected sub-cylinders. Pressure vessels of a smaller size would with this construction have a shorter time of delivery.

A problem with such axially divided high pressure vessels, is sufficient sealing of the joint between the sub-cylinders. Leaking pressure medium may cause corrosion or difficulties regarding reaching and keeping the desired high pressures. Should pressure medium leak into the joint and be trapped, the leaked pressure medium may transfer considerable separating forces to the sub-cylinders, which may lead to damages in the connection between the sub-cylinders or even separation of the sub-cylinders.

Another problem associated with sealing arrangements in high pressure presses is that they are prone to wear and difficult to replace.

SUMMARY OF THE INVENTION

An object of the present invention is thus to alleviate at least some of the above mentioned problems.

This object is achieved with a pressure vessel with features according to the appended claims 1 and 17. Alternative embodiments are defined in the dependent claims 2-16.

A pressure vessel for a high pressure press according to the invention comprises at least a first sub-cylinder and a second sub-cylinder, which are axially connected to form a cylinder body for enclosing a high pressure medium; and a sealing arrangement arranged at the inner wall of the cylinder body for sealing the joint between the first and the second sub-cylinder against leakage of the pressure medium. The sealing arrangement comprises a ring shaped sealing band; a first circumferential protruding flange, which is arranged on the inner wall of the first sub-cylinder and which axially extends from the joint and away from the second sub-cylinder; a second circumferential protruding flange, which is arranged on the inner wall of the second sub-cylinder and which axially extends from the joint and away from the first sub-cylinder. The sealing band, in mounted position, is located concentrically within the first and the second protruding flanges such that it in a radially pre-stressed manner abuts against the first and second protruding flanges and sealingly overlaps the joint between the first and the second sub-cylinder. The sealing arrangement further comprises a first circumferential mounting space, which is arranged in the inner wall of the first sub-cylinder and which axially extends from the first protruding flange and away from the second sub-cylinder, for facilitating exchange of components of the sealing arrangement.

A method for replacing a worn sealing band of a pressure vessel as described above, comprises according to the invention the steps of removing the worn sealing band out of the pressure vessel, inserting a tool having a wedge surface into the first mounting space such that the wedge surface forms a sliding surface axially at least along a distance between the bottom of the first mounting space and an innermost radial end of the first protruding flange, and at least at selected circumferential portions, deforming a circular replacement sealing band into an oval-like shape, introducing the deformed replacement sealing band into the pressure vessel, placing the deformed replacement sealing band in the first mounting space, deforming, in the first mounting space, the deformed replacement sealing band back to substantially the original circular shape thereof, and the step of pushing the replacement sealing band over the wedge-surface of the tool into a sealing position concentrically within the first and the second protruding flanges such that it in a radially pre-stressed manner abuts against the first and second protruding flanges and sealingly overlaps the joint between the first and the second sub-cylinder.

Due to the sealing band abutting against the joint in a pre-stressed manner, a desired contact pressure between the sealing band and the joint, which contact pressure ensures sufficient sealing for the high pressures in question, is achievable. The desired contact pressure is provided by the pre-stressed sealing band bearing against the joint trying to expand to an original, relaxed condition. By selecting a suitable diameter and thickness of the sealing band and a suitable radial protrusion of the protruding flanges, a desired contact pressure can be achieved and thus the desired sealing.

Due to the provision of the first mounting space, it is possible to replace a sealing band according to the invention with a new sealing band, wherein also the new sealing band will bear against the joint with sufficient contact pressure, which is provided by a pre-stress in the sealing band. After a worn sealing band has been removed, for example by cutting the sealing band into pieces, a new sealing band can be introduced into the pressure vessel, wherein the sealing band is deformed and suitably turned such that an outer sealing surface of the sealing band is not harmed by the inner wall of the cylinder body. Then, using the additional space of the mounting space, it is possible to turn the new sealing band in position for being compressed and pushed over the protruding flanges for assuming a pre-stressed mounting position. Thanks to the protruding flanges and the mounting space according to the invention, the sealing band needs only to be pushed the short distance of the axial extension of the protruding flanges in a maximal pre-stressed state, whereby the risk for harming the outer sealing surface of the sealing band is reduced.

In contrast, in prior art pressure vessels comprising cylinder bodies having flush inner walls, the sealing is normally applied over the joint during assembly of the pressure vessel in a stage where the pressure vessel still is relaxed. Then, the sealing band is pre-stressed for providing the desired contact pressure together with the pressure vessel during application of the pre-stressing means, for example a metal band which is wound around the outer envelop surface of the pressure vessel. In such prior art pressure vessels, for example when replacing an old sealing band by a new sealing band when the pressure vessel is radially pre-stressed, it is not possible or at least very difficult to put a sealing band into position without serious damaging the outer sealing surface of the sealing band, because the sealing band would experience high compressing forces when sliding over the inner wall surface.

Due to the method according the invention of pushing the sealing band from the mounting space on to and over the protruding flanges by using a tool having a wedge-shaped surface, the compression of the sealing band is facilitated and the risk of damaging the outer sealing surface of sealing band and any edges or corners of the protruding flanges is reduced.

A pressure vessel of the present invention comprises a cylinder body which is closed at the ends by for example lids. One lid can for example be arranged to be opened and closed at loading the pressure vessel with objects or articles to be pressure treated in a pressure process of the pressure vessel.

The cylinder body and the lids are normally held in place by a framework. Thus, from the prior art it is known to hold a cylinder body and the lids thereof axially together by an external frame, which extends on the outside of the cylinder body from a lid at one end to a lid at the other end.

The cylinder body of the pressure vessel is arranged to hold the articles to be high pressure treated. The cylinder body is normally filled up with a high pressure medium before a high pressure process begins. A pressure vessel according to the invention is adapted to operate at high pressures. The pressure level in the pressure vessel of the present invention depends on the press type and the material to be pressed. In sheet metal forming the press is typically designed for pressures up to 140 MPa, in CIP for between 100 MPa and 600 MPa and in HIP for up to 300 MPa.

The high pressure medium is normally a fluid, for example argon gas, oil or water.

A cylinder body, as used herein, generally refers to a tubular body having a substantially circular cross-section and cylinder walls.

An axial direction, for the purpose of the present application, is the direction along the central axis of the cylinder body. The radial direction is perpendicular to the axial direction and is thus directed radial in the cylinder body. A circumferential extension refers to a circular extension of the cylinder body, for example along an inner surface or around an outer surface.

The cylinder body of the present invention comprises two or more sub-cylinders. A sub-cylinder is a cylinder-shaped part. When one sub-cylinder is axially connected to another sub-cylinder a cylinder body is formed comprising the two sub-cylinders. Thus, the present invention is not limited to the use of two sub-cylinders, the cylinder body may comprise three, four, five or any other suitable number sub-cylinders.

The ring shaped sealing band of the present invention is for example made of a bronze material. The sealing band is of a ring-shape with an extension in its axial direction. The sealing band is arranged to be compressed in the radial direction when in the position at the protruding flanges such that the joint between the protruding flanges is sealed by the sealing band. The outer surface and geometry of the sealing band is provided with shape and a surface roughness that is adapted for the sealing against the flanges. The inner surface and geometry of the sealing band, facing the inner of the cylinder body, can be of any profile or surface roughness. The inner geometry is preferably shaped such that the space and shape of the cylinder body is substantially the same as for a single cylinder.

The circumferential protruding flanges are arranged as a protruding part of the inner cylinder wall. The flanges are protruding from the mounting space, such that the inner diameter in the mounting space is larger than the diameter at the flanges. The flanges are circumferential and have an extension in the axial direction such that a plateau is formed on each side of the joint, on to which plateau the sealing band is to be abutted. The flanges are preferably arranged symmetrically around the joint, although an asymmetric arrangement is also intended to be a part of the present invention.

The circumferential mounting space of the present invention, which mounting space is arranged in the inner wall of the first sub-cylinder and which axially extends from the first protruding flange and away from the second sub-cylinder, is arranged for facilitating exchange of components of the sealing arrangement. The exchange of components of the sealing arrangement comprises for example exchange of auxiliary sealing arrangements and exchange of the sealing band.

The method of replacing a worn sealing band of the present invention is applicable on replacing a sealing band that is mounted in a pre-stressed pressure vessel. The sealing band does not have to be worn out to be replaced, the replacement can be performed of safety or operational reliability reasons. The removing of a sealing band can be performed by for example sawing, folding or plastically deforming the sealing band such that it can be removed out of the pressure vessel without harming the inner wall of the cylinder body.

By deforming a circular replacement sealing band into an oval-like shape, any contact between the inner surface of the cylinder body and the sealing band can be avoided during insertion of a fresh sealing band into the cylinder body. Any contact between them implies a risk for scratch formations and are disadvantageous in respect of sealing properties.

The dimension, depth and width, of the mounting space is adapted to geometrically fit the deforming of the new sealing band from the oval-like shape back to substantially the original, unstressed shape thereof. The mounting space does furthermore fit both the tool and the sealing band at the same time, such that the method of replacing the sealing band can be performed. The inner diameter of the mounting space is furthermore dimensioned such that it is possible to, during the method of replacing the worn sealing band, deform the new sealing band substantially back into its original circular shape when the sealing band is located in the mounting space.

The contact pressure between the sealing band in the mounted position and the protruding flanges is dependent on parameters such as the original diameter of the unstressed sealing band, the diameter of the sealing band when mounted in the sealing position against the protruding flanges, the material, geometry and thickness of the sealing band, and thereby its elastic response to the compressive deformation, and the total area of the interface between the sealing band and the protruding flanges. The properties of the sealing band and the contact situation is preferably chosen such that the sealing band is elastically deformed into its sealing position. Thereby the sealing properties of the sealing band can be maintained even during movements of the cylinder wall which may arise during a high pressure process. The level of the contact pressure is furthermore matched after the design and parameters of the pressure vessel and its high pressure levels.

The mounting space can for example be formed by forming an inner diameter at the flanges that is of a smaller dimension than the inner diameter of the rest of the cylinder. Alternatively the rest of the cylinder is of the same inner diameter as the diameter at the flanges, while the mounting space is of a larger diameter, countersunk in inner the cylinder wall.

In one embodiment of the invention, the protruding flanges protrude such a radial distance in the radial direction towards the centre of the cylinder body, and the sealing band has such an outer diameter in an unstressed state, that the sealing band, in mounted position, is radially pre-stressed by being elastically compressed and a contact pressure between the sealing band and the protruding flanges is at least 2 MPa. The smaller dimension of the pressure vessel, the higher is the preferable contact pressure. The contact pressure can thus be chosen and dimensioned by varying the rate of flange protrusion, the material of the sealing band and the outer diameter of the sealing band in an unstressed state.

In one embodiment of the invention the protruding flanges have a circumferential, sealing contact surface, respectively, for sealingly contacting a corresponding sealing surface on the sealing band, and wherein the contact surfaces axially extends in parallel with central axis of the cylinder body. An advantage with a contact surface extending parallel to the central axis of the cylinder body is that a sealing band can be pushed or pulled with equal pressure in the axial direction. Furthermore, the pressure acting on the sealing band during an application of the pre-stressing or during pressure processes will be mainly in the radial direction and will not tend to move the sealing band in the axial direction out of its sealing position.

In one embodiment of the invention the sealing band is provided with a bevelled edge along at least one of the circumferential edges thereof. This bevelled edge can be used at mounting a new sealing band according to the method of claim 17, wherein the bevelled edge can be arranged to slide along a surface of the tool. An additional advantage with the bevelled edge of the sealing band is that the risk for scratches or material damage of the sealing band, the tool or the protruding flanges is reduced.

In an embodiment of the invention, the sealing band is made of a metallic material, preferably bronze. The sealing band is preferably made of a material that does not plastically deforms during the pre-stressing or the high pressure process, with a hardness lower than the hardness of the sub-cylinders and with advantageous sealing properties.

In an embodiment of the invention, the first mounting space is such dimensioned that, when the sealing band in a pre-mounted position is located in the first mounting space, the sealing band is preferably substantially unstressed. A substantially unstressed sealing band is advantageous in the replacing of a worn sealing band. It is less complicated to deform an unstressed sealing band into its original circular shape than it is to deform a stressed sealing band into its original circular shape.

In an embodiment of the invention, the sealing band, in mounted position, has a circumferential portion axially extending past the first protruding flange and over a portion of the first mounting space such that a circumferential sealing channel is formed between the sealing band, a radial surface of the first protruding flange and the inner wall of the first sub-cylinder; and wherein the sealing arrangement further comprises a circumferential auxiliary sealing arrangement, which is arranged in the sealing channel for sealing the joint between the sealing band and the first protruding flange. An auxiliary sealing arrangement is advantageous in that the sealing arrangement and the joint thereby are additionally sealed. The portion of the sealing band that axially extends past the first protruding flange can furthermore be used as a grip member at the removing of a worn sealing band and at the placing and pushing of the replacement sealing band.

In an embodiment of the invention the first mounting space has such an axial extension that access to the sealing channel from within the cylinder body for replacement of at least components of the auxiliary sealing arrangement is enabled. Components of the auxiliary sealing arrangement can thus be replaced while the sealing band is left in the mounted position. The sealing channel can furthermore be inspected in the control of crack initiations via the mounting space for example by casting with a non-destructive casting material. Alternatively the sealing channel can be ocularly or visually inspected or controlled by slightly moving the sealing band axially in the direction that exposures the sealing channel.

The auxiliary sealing arrangement does in an embodiment comprise a soft seal, for example an o-ring, a square-ring or a u-cup seal. The auxiliary sealing arrangement can alternatively comprise more than one soft seal arranged in the same sealing channel, and the space between two soft seals can be used for keeping for example a corrosion inhibitor such as a grease.

In an embodiment of the invention the sealing arrangement further comprises a locking member arranged in the first mounting space for preventing axial movement of the sealing band in mounted position. The locking member can further be utilised as a sliding stop or guide at replacing of the sealing band and the pushing of the sealing band into the sealing position.

In one embodiment of the invention the locking member comprises a circlip. The circlip is advantageous in that it facilitates the mounting and removing of the locking ring.

In an embodiment of the invention, the first mounting space is formed by a circumferential mounting groove in the inner wall of the first sub-cylinder, the radial thickness of the locking member is equal to the combined radial thickness of the first protruding flange and the sealing band, and wherein the locking member axially extends from an circumferential edge of the sealing band to the distal end of the mounting groove, whereby the radial inner surfaces of the sealing band, the locking member and the inner surface of the cylinder body outside the mounting groove are flush. A flush inner surface of the cylinder body is advantageous in the internal arrangement of the holders for the articles or objects to be pressure treated. A flush inner surface is further advantageous in the loading and the unloading of the articles or objects.

In another embodiment of the invention the sealing arrangement further comprising a second circumferential mounting space, which is arranged in the inner wall of the second sub-cylinder, axially extends from the second protruding flange and away from the first sub-cylinder, and which is arranged as the first circumferential mounting space and cooperates with corresponding features of the sealing arrangement as the first circumferential mounting space. In one embodiment of the invention the sealing arrangement is symmetrical over the joint between the first and second sub-cylinders. A symmetrical sealing arrangement is advantageous in that for example an auxiliary sealing arrangement can be placed to seal also the joint between the sealing band and the second protruding flange. The advantages with the features disclosed on an asymmetric sealing arrangement above can be applied also at the symmetrical sealing arrangement.

In one embodiment of the invention, pre-stressing means are provided around the envelope surface of the cylinder body such that the cylinder body is radially pre-stressed. The pre-stressing means can be wire winding or shrinkage or any other pre-stressing means. A radial pre-stressing of the cylinder body is advantageous in that the ability of the pressure vessel to resist crack formation and propagation is increased.

In one embodiment of the invention, the first sub-cylinder and the second sub-cylinder are axially connected by a securing member, wherein the first sub-cylinder is provided with a first seat for receiving a first part of the securing member, the second sub-cylinder is provided with a second seat for receiving a second part of the securing member, the securing member is fitted in the first and second seats, the securing member, and the first and second seats are arranged such that the securing member, and the first and second seats cooperate to prevent relative axial movement between the first and the second sub-cylinders, and wherein the pre-stressing means is provided around the envelop surface of the cylinder body such that the cylinder body is radially pre-stressed and such that the securing member is locked in the first and second seats.

The securing member of the present invention is a member arranged to hold, fasten, connect or secure the first and the second sub-cylinders together to prevent separating axial movement between the sub-cylinders.

Due to the provision of a pressure vessel comprising a first and a second sub-cylinder with a securing member that is arranged in seats in the first and the second sub-cylinder, the securing member can be locked by the pre-stressing means and thereby separating axial movements can be prevented. The axial connection between two sub-cylinders is based on a combination of, on one hand, the securing member and the first and second seats being configured and arranged to cooperate to prevent separating axial forces, and, on the other hand, the pre-stressing means being arranged to lock the securing member in the seats. In addition to hold the force absorbing securing member reliably in place in the seats, the pre-stressing means adds additional strength to the mechanical connectors (seats and securing member). Consequently, a reliable connection between two sub-cylinders is achievable.

The securing member is preferably located in connection to the joint between two sub-cylinders and thereby not requiring any additional space at the cylinder far from the joint. This is advantageous in that the rest of the pressure vessel design does not have to be adapted or redesigned from the one comprising a homogeneous cylinder body. The number of connected sub-cylinders is not restricted due to for example lack of connection space and the cylinder body can thus comprise several more than two connected sub-cylinders.

Ideally no leakage occurs out from the pressure vessel. However, if a leakage would occur at the sealing means, pressure medium would flow out of the cylinder body.

The joint between the first and the second sub-cylinder is in one embodiment provided with at least one radial drain channel extending from the sealing arrangement at the inner side of the cylinder body, radially through the cylinder body and out to the inlet of the through drain hole of the securing member.

In one embodiment of the invention, the securing member is arranged with at least one through drain hole with an inlet at the joint between the first and the second sub-cylinder, extending radially through the securing member.

A drain channel is in an embodiment arranged in the axial direction of the cylinder body between the cylinder body and the pre-stressing means. One example of such construction is to arrange rods around the envelope surface of the cylinder body. The spaces between the rods and the envelope surface of the cylinder body, when the rods are arranged along the outer surface of the cylinder body, are then forming drain channels in the axial direction of the cylinder body. The rods can be of a circular through cut, but are preferably edged and most preferably 6-edged.

The cross-sectional area of the drain hole and the drain channels are in one embodiment such arranged that a leaking flow of pressure medium leaking out of the cylinder body via the joint between the first and the second sub-cylinder and into a radial drain channel, a drain hole and an axial drain channel, will follow a path with equal or expanding cross-sectional area. This is to reduce the flow resistance in the direction of drain flow such that for example forces acting in the separating direction of the sub-cylinders are avoided.

The drain arranged in the pressure vessel is advantageous in that a leakage can be observed in an early stage. The leakage control is important of safety and performance reasons. If a leakage is not noticed at an early stage, there is an increased risk for a pressure vessel collapse.

Generally, all terms used in the claims are to be interpreted according to their ordinary meaning in the technical field, unless explicitly defined otherwise herein.

Other objectives, features and advantages of the present invention will appear from the following detailed description, the attached dependent claims and from the appended drawings.

BRIEF DESCRIPTION OF DRAWINGS

The above, as well as additional objects, features and advantages of the present invention, will be better understood through the following illustrative and non-limiting detailed description of preferred embodiments of the present invention, with reference to the appended drawings, wherein.

DETAILED DESCRIPTION OF PREFERRED EMBODIMENTS

Figure 1:
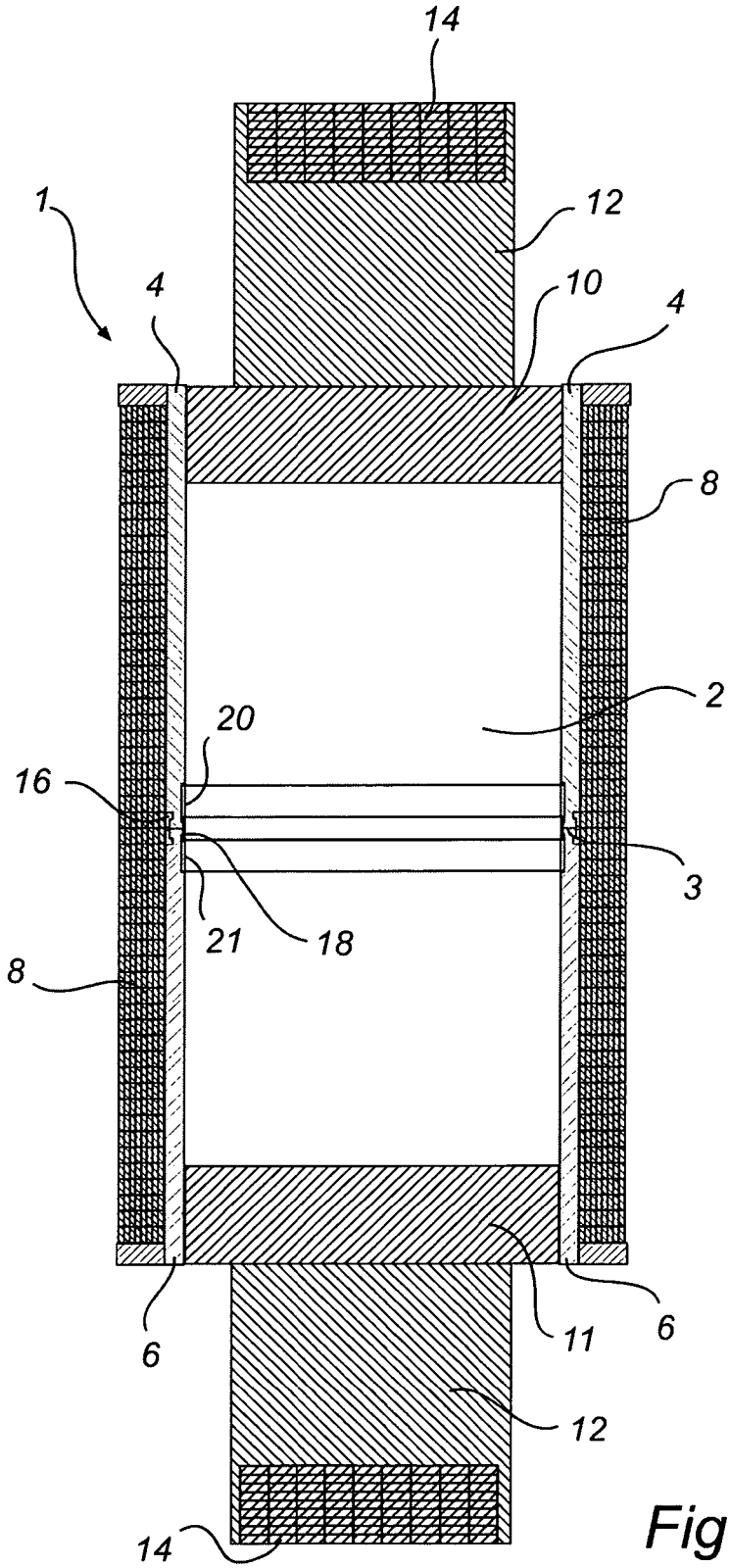
FIG. 1 is a schematic sectional view of a pressure vessel according to an embodiment of the present invention.

FIG. 1 is a schematic cross section view of a pressure vessel 1 according to one embodiment of the invention. The pressure vessel 1 comprises a cylinder body 2 comprising of two connected sub-cylinders 4, 6. The cylinder body 2 is closed at the ends by lids 10, 11 which are hold in place by a framework 12. The cylinder body 2 is arranged to hold the articles to be high pressure treated.

The outer envelope surface of the cylinder body 2 is provided with a pre-stressing means in the form of a package of wound steel bands 8. The bands are wound tightly radially around the envelope surface of the cylinder body 2 to provide a radial compressive stress in the pressure vessel wall. The band is wound in a helical manner from one end of the cylinder to the other and back. The bands have a rectangular cross-sectional shape and is wound edge to edge. Each winding from one end to the other forms a separate pre-stressing layer, and the entire pre-stressing means comprise several layers of wound steel bands.

The framework 12 is also provided with a package of wound steel bands 14 to assist the framework 12 in taking up axial loads. To open the pressure vessel 1, the framework 12 is moved in the direction perpendicular to the axial direction of the cylinder body 2, whereby a lid 10, 11 can be removed giving access to the inner side of the cylinder body 2.

The two sub-cylinders 4, 6 are axially connected by a securing member 16 which is hold in place by the radially pre-stressing means in the form of the package of wound steel bands 8 arranged around the envelope surface of the cylinder body 2.

The inner wall of the cylinder body 2 is provided with a sealing arrangement sealing the joint 3 between the two sub-cylinders 4, 6. The sealing arrangement is comprising a sealing band 18 axially hold in place by locking members 20, 21. The sealing arrangement is described in more detail below with reference to FIG. 2.

Figure 2:
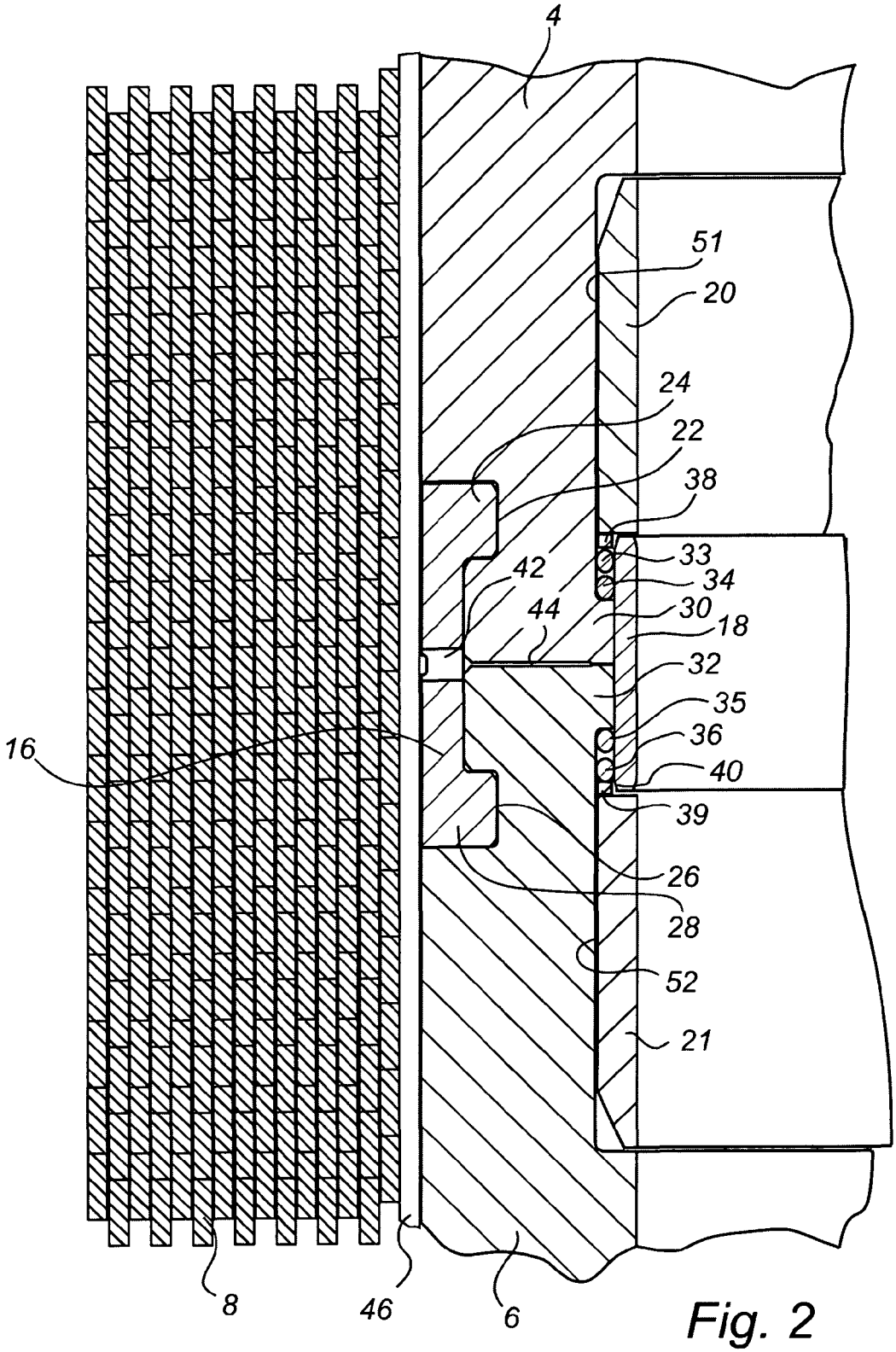
FIG. 2 is a schematic view of a sealing arrangement according to an embodiment of the present invention.

FIG. 2 shows a close up view of the joint 3 between the two sub-cylinders 4, 6 according to one embodiment of the invention. A wall of the cylinder body 2 and the package of wound steel bands 8 are shown in through cut at the area of the joint 3. A striped area represents a detail in through cut.

The two shown sub-cylinders 4, 6 are cylinder-shaped parts with a circular cross-section and the thickness of the sub-cylinder walls and the outer and inner diameter are of the same dimension.

The two sub-cylinders 4, 6 are axially connected by a securing member 16 arranged in the outer wall of the cylinder body 2. A first seat 22 is arranged in the outer wall of the first sub-cylinder 4, and a second seat 26 is arranged in the outer wall of the second sub-cylinder 6. The securing member 16 is fitted in the first and second seats 22, 26 of the sub-cylinders 4, 6, symmetrically overlapping the joint 3 between the two sub-cylinders 4, 6. A first part 24 of the securing member 16 is arranged in the first seat 22 of the first sub-cylinder 4 and a second part 28 of the securing member 16 is arranged in the second seat 26 arranged in the second sub-cylinder 6. The securing member comprises two circular-arc-shaped segments that, when fitted in the seats 22, 26 extends circumferentially around the cylinder body 2.

The securing member 16 is countersunk in the wall of the cylinder body 2 such that the outer surface of the cylinder body 2, comprising the two connected sub-cylinders, is flush. The first seat 22 is countersunk in the first sub-cylinder 4 and the second seat 26 is countersunk in the second sub-cylinder 28 such that the securing member 16 fit in the seats 22, 26 and such that the radially outermost surface of the securing member is parallel to the radially outermost surface of the two connected sub-cylinders. Thereby stress concentrations is avoided and the compressive stress exerted by the pre-stressing means is evenly distributed.

The pressure vessel 1 of is provided with a sealing arrangement arranged at the inner wall of the cylinder body 2, sealing the joint 3 between the two sub-cylinders 4, 6. The sealing arrangement comprises a sealing band 18, locking rings 20, 21, o-rings 33, 34, 35, 36, protruding flanges 30, 32, spacers 38, 39 and mounting spaces 51, 52.

The sealing band 18 is made of bronze and the spacers 38, 39 are made of a plastic material. The locking rings 20, 21 are circlips.

The sealing band 18 is located concentrically at the first and second protruding flanges 30, 32 and in an radially pre-stressed manner abuts against the first and the second protruding flanges 30, 32 and sealingly overlaps the joint 3 between the first and the second sub-cylinder 4, 6.

To additionally seal the axial connection between the two sub-cylinders 4, 6, an auxiliary sealing arrangement is provided. A circumferential portion of the sealing band 18 axially extend past the protruding flanges 30, 32 such that a sealing channel is formed under both the protruding flanges 30, 32. A sealing channel is formed between an axially extending portion of the sealing band 18, a radial surface of the protruding flange 30, 32 and an inner wall of the sub-cylinder 4, 6. Each sealing channel is provided with two o-rings 33, 34, 35, 36 and a spacer 38, 39. In between two adjacent o-rings 33, 34 or 35, 36 a grease is provided to act as a corrosion inhibitor. The spacer 38, 39 is mounted to act as a hindrence and to prevent the o-rings 33, 34, 35, 36 from leaving the sealing channel.

The sealing band 18 is axially hold in place by locking members 20, 21 arranged in the mounting spaces 51, 52 at both sides of the sealing band 18. The locking member 20, 21 is dimensioned to axially fit in the mounting space 51, 52.

The inner surface of the cylinder body 2, with the sealing arrangement mounted, is arranged to be flush, such that geometry and shape of the inside of the cylinder body 2 is unaffected by the sealing arrangement.

Figure 3:
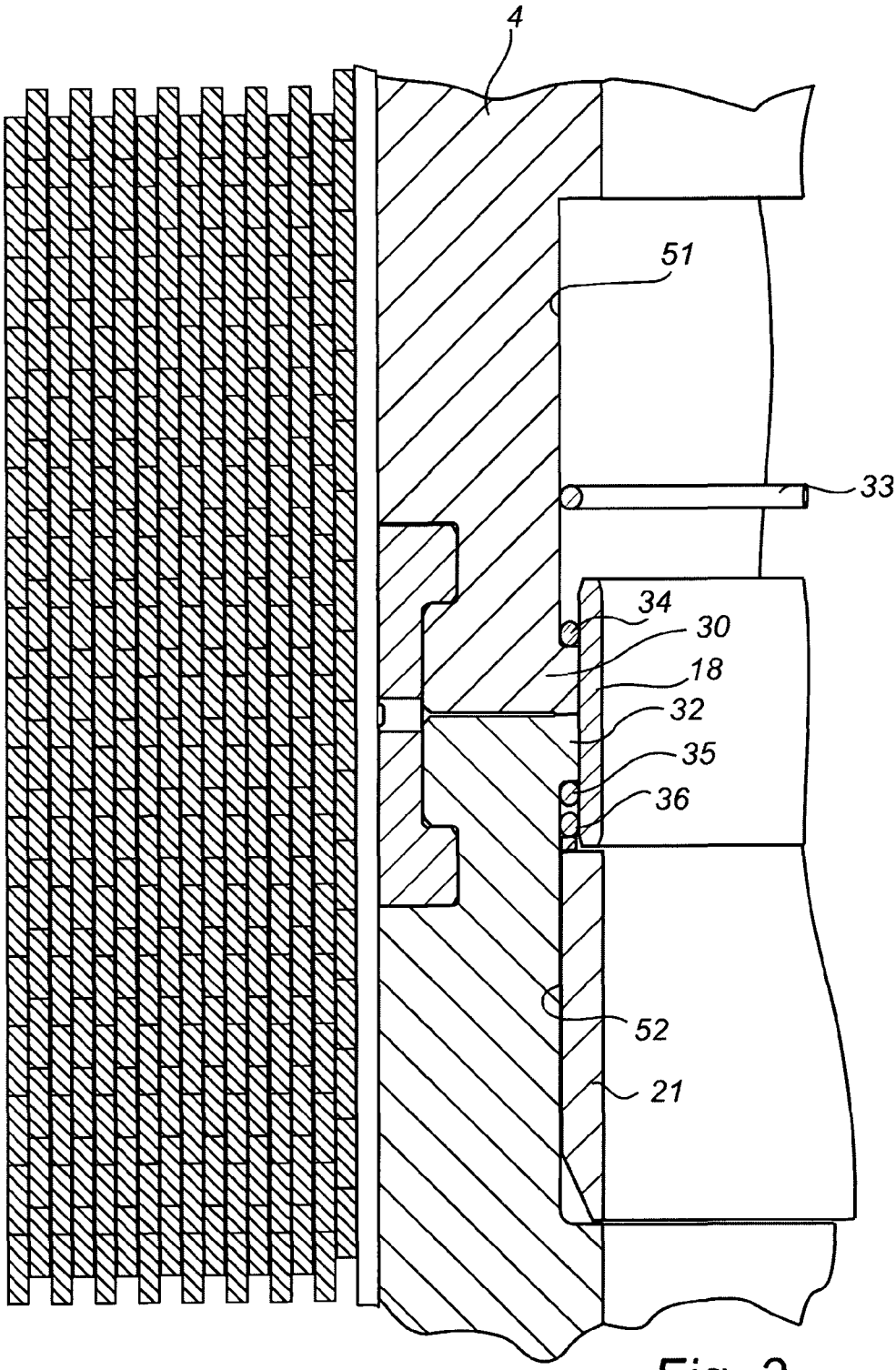
FIG. 3 is a corresponding schematic view as FIG. 2 according to an embodiment of the present invention, wherein an o-ring is to be replaced.

The mounting space 51, 52 is circumferential and is arranged to facilitate exchange of components of the sealing arrangement. The dimension of a mounting space 51, 52 is sufficient to give access to the o-rings 33, 34, 35, 36 when the adjacent locking ring 20, 21 and spacer 38, 39 are removed, but while the sealing band 18 is in its mounted position. An o-ring 33 in an exchange process is shown in FIG. 3. The upper locking member 20 has been moved out of the pressure vessel whereby the outermost o-ring 33 is made accessable. Even the innermost o-ring 34 is accessable and thereby replaceably via the mounting space 51. For example two new o-rings and grease can be placed in the sealing channel. The sealing channel, and especially the surface of the sub-cylinder 4, 6 can furthermore be inspected via the mounting space 51, 52.

Figure 4:
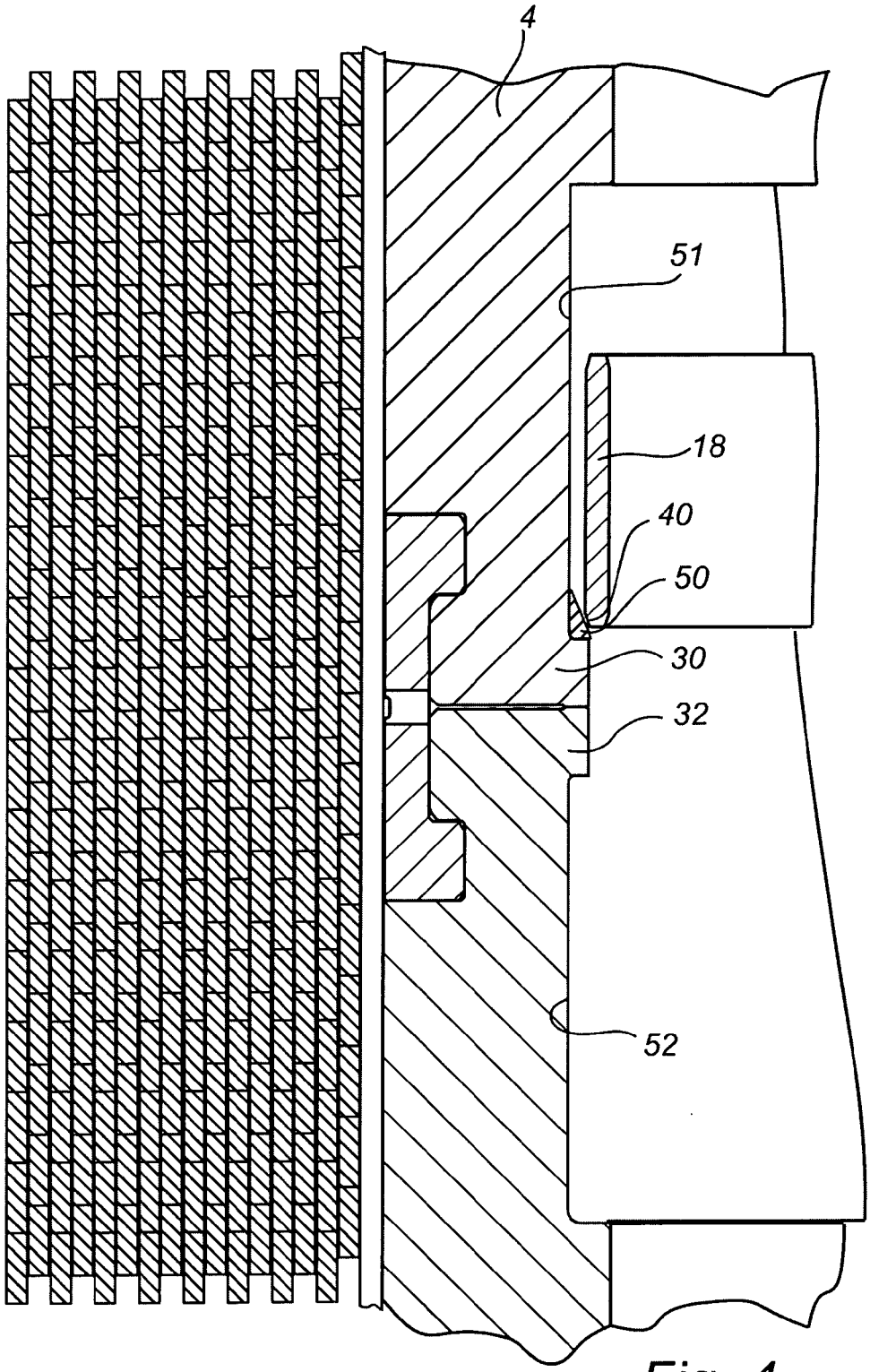
FIG. 4 is a corresponding schematic view as FIG. 2 according to an embodiment of the present invention, wherein the sealing band is to be replaced.

The present invention further comprises a method of replacing a worn sealing band 18. An example of one of the replacement steps is shown in FIG. 4. A tool 50 having a wedge surface has been inserted into the first mounting space 51 such that the wedge surface forms a sliding surface axially along the distance between the bottom of the first mounting space 51 and an innermost radial end of the first protruding flang 30 and radially along a circumferential portion of the mounting space 51.

A new sealing band 18 has been introduced into the pressure vessel 1 in an oval-like shape. The sealing band 18 has been placed in the mounting space 51 and deformed back into its original circular shape.

FIG. 4 shows the sealing band 18 during the step of pushing the sealing band 18 over the wedge surface of the tool 50 into a sealing position concentrically within the first and the second protruding flanges 30, 32. The sealing band 18 is provided with a bevelled edge 40 along which the sealing band 18 is sliding against the tool 50. The pushing of the sealing band 18 implies a compression of the sealing band 18 from an original unstressed state when in the mounting space 51 into a radially compressed state when the sealing band 18 abuts against the protruding flanges 30, 32. When the new replaced sealing band 18 has been moved into the position on top of the protruding flanges 30, 32, it sealingly overlaps the joint 3 between the two sub-cylinders 4, 6.

In FIG. 4, both locking members 20, 21 are removed out of the cylinder body 2, although to facilitate the replacement of the sealing band 18, only one of the locking members 20, 21 needs to be removed from the mounting space 51, 52. New o-rings 33, 34, 35, 36 and spacers 38, 40 are preferably mounted as the new sealing band is mounted.

The pressure vessel 1 of FIGS. 1-4 further comprises a drain arrangement comprising radial drain channels 44 arranged at the interface in the joint of the first and the second sub-cylinder, drain holes 42 arranged in the securing member and rods 46 arranged inbetween the envelope surface of the cylinder body 2 and the pre-stressing means 8 forming axially directed drain channels.

The securing member 16 is provided with a through drain hole 42 with an inlet at the joint 3 between the first and the second sub-cylinder 4, 6, extending radially through the securing member 16. Such through drain holes 42 arranged are at a frequent interval around the circumference of the securing member 16, see FIG. 3.

The joint 3 between the two sub-cylinders 4, 6 is provided with radial extending drain channels 44 extending from the sealing arrangement 18 at the inner side of the cylinder body 2, and radially through the cylinder body 2 and to the inlet of a through drain hole 42 of the securing member 16.

6-edged rods 46 are arranged around the outer envelope surface of the cylinder body 2 inbetween the cylinder body 2 and the prestressing means. The rods 46 are placed side to side around the cylinder body 2 whereafter the prestressing means is applied. An axial extending channel is formed between each pair of adjacent rods and the surface of the cylinder body 2, whereby drain channels are formed in the axial direction, along the envelope surface, of the cylinder body 2.

Ideally no leakage occurs out from the pressure vessel. However, if a leakage would occur at the sealing means, pressure medium would flow out of the cylinder body 2. The leakage flow would follow a path, via the sealing means, first via the radial extending drain channel 44, then pass the through drain hole 42 and finally follow the axial extending drain channel. The diameters or cross-sectional area of the path of a leakage flow is arranged such that the flow will follow a path of a equal of expanding diameter or cross-sectional area. Thereby a pressure medium that has leaked out through the joint 3 will flow with low flow resistance and the separating forces acting on the sub-cylinders will be reduced. This drain arrangement makes it possible to notice a leakage at an early stage. Depending on the shape of the cross sectional area the size of the area may have to be additionally adjusted to achieve the desired result of a low flow resistance.

The invention claimed is:

1. A pressure vessel for a high pressure press comprising at least a first sub-cylinder and a second sub-cylinder, which are axially connected to form a cylinder body for enclosing a high pressure medium, a sealing arrangement arranged at the inner wall of the cylinder body for sealing the joint between the first and the second sub-cylinder against leakage of the high pressure medium, the sealing arrangement comprising a ring shaped sealing band, a first circumferential protruding flange, which is arranged on the inner wall of the first sub-cylinder and which axially extends from the joint and away from the second sub-cylinder, a second circumferential protruding flange, which is arranged on the inner wall of the second sub-cylinder and which axially extends from the joint and away from the first sub-cylinder; wherein the sealing band, in mounted position, is located concentrically within the first and the second protruding flanges such that it in a radially pre-stressed manner abuts against the first and second protruding flanges and sealingly overlaps the joint between the first and the second sub-cylinder, and wherein the sealing arrangement further comprises a first circumferential mounting space, which is arranged in the inner wall of the first sub-cylinder and which axially extends from the first protruding flange and away from the second sub-cylinder, for facilitating exchange of components of the sealing arrangement.

2. The pressure vessel for a high pressure press according to claim 1, wherein the protruding flanges protrude such a radial distance in the radial direction, and the sealing band has such an outer diameter in an unstressed state, that the sealing band, in mounted position, is radially pre-stressed by being elastically compressed and a contact pressure between the sealing band and the protruding flanges is at least 2 MPa.

3. The pressure vessel for a high pressure press according to claim 1, wherein the protruding sealing flanges have a circumferential, sealing contact surface, respectively, for sealingly contacting a corresponding sealing surface on the sealing band, and wherein the contact surfaces axially extends in parallel with central axis of the cylinder body.

4. The pressure vessel for a high pressure press according to claim 1, wherein the sealing band has a circumferential edge which is provided with a beveled edge.

5. The pressure vessel for a high pressure press according to claim 1, wherein the sealing band is made of a metallic material.

6. The pressure vessel for a high pressure press according to claim 1, wherein the first mounting space is such dimensioned that, when the sealing band is in a pre-mounted position, it is located in the first mounting space.

7. The pressure vessel for a high pressure press according to claim 1, wherein the sealing band, in mounted position, has a circumferential portion axially extending past the first protruding flange and over a portion of the first mounting space such that a circumferential sealing channel is formed between the sealing band, a radial surface of the first protruding flange and the inner wall of the first sub-cylinder; and wherein the sealing arrangement further comprises a circumferential auxiliary sealing arrangement, which is arranged in the sealing channel for sealing the joint between the sealing band and the first protruding flange.

8. The pressure vessel for a high pressure press according to claim 7, wherein the first mounting space has such an axial extension that access to the sealing channel from within the cylinder body for replacement of at least components of the auxiliary sealing arrangement is enabled.

9. The pressure vessel for a high pressure press according to claim 7, wherein the auxiliary sealing arrangement comprises a soft seal.

10. The pressure vessel for a high pressure press according to claim 1, wherein the sealing arrangement further comprising a locking member arranged in the first mounting space for preventing axial movement of the sealing arrangement in mounted position.

11. The pressure vessel for a high pressure press according to claim 10, wherein the first mounting space is formed by a circumferential mounting groove in the inner wall of the first sub-cylinder, the radial thickness of the locking member is equal to the combined radial thickness of the first protruding flange and the sealing band, and wherein the locking member axially extends from an circumferential edge of the sealing band to the distal end of the mounting groove, whereby the radial inner surfaces of the sealing band, the locking member and the inner surface of the cylinder body outside the mounting groove are flush.

12. The pressure vessel for a high pressure press according to claim 10, wherein the locking member is a circlip.

13. The pressure vessel for a high pressure press according to claim 1, wherein the sealing arrangement further comprises a second circumferential mounting space, which is arranged in the inner wall of the second sub-cylinder, axially extends from the second protruding flange and away from the first sub-cylinder, and which is arranged as the first circumferential mounting space and cooperates with corresponding features of the sealing arrangement as the first circumferential mounting space.

14. The pressure vessel for a high pressure press according to claim 13, wherein the sealing arrangement is symmetrical over the joint between the first and second sub-cylinders.

15. The pressure vessel for a high pressure press according to claim 1, wherein the pressure vessel further comprising pre-stressing means provided around the envelop surface of the cylinder body such that the cylinder body is radially pre-stressed.

16. The pressure vessel for a high pressure press according to claim 15, wherein the first sub-cylinder and the second sub-cylinder are axially connected by a securing member, wherein the first sub-cylinder is provided with a first seat for receiving a first part of the securing member, the second sub-cylinder is provided with a second seat for receiving a second part of the securing member, the securing member is fitted in the first and second seats, the securing member, and the first and second seats are arranged such that the securing member, and the first and second seats cooperate to prevent relative axial movement between the first and the second sub-cylinders, and wherein the pre-stressing means is provided around the envelop surface of the cylinder body such that the cylinder body is radially pre-stressed and such that the securing member is locked in the first and second seats.

17. A method for replacing a worn sealing band of a pressure vessel according to claim 1, comprising the steps of removing a worn sealing band out of the pressure vessel, inserting a tool having a wedge surface into the first mounting space such that the wedge surface forms a sliding surface axially at least along a distance between a bottom of the first mounting space and an innermost radial end of the first protruding flange, and at least at selected circumferential portions, deforming a circular replacement sealing band into an oval-like shape, introducing the deformed replacement sealing band into the pressure vessel, placing the deformed replacement sealing band in the first mounting space, deforming, in the first mounting space, the deformed replacement sealing band back to substantially the original circular shape thereof, and a step of pushing the replacement sealing band over the wedge-surface of the tool into a sealing position concentrically within the first and the second protruding flanges such that the sealing band in a radially pre-stressed manner abuts against the first and second protruding flanges and sealingly overlaps the joint between the first and the second sub-cylinder.

18. The pressure vessel for a high pressure press according to claim 5, wherein the metallic material is bronze.

19. The pressure vessel for a high pressure press according to claim 6 wherein the sealing band is substantially unstressed in the first mounting space.

* * * * *